US012303028B2

(12) United States Patent
Chen et al.

(10) Patent No.: US 12,303,028 B2
(45) Date of Patent: May 20, 2025

(54) SLIDE RAIL ASSEMBLY AND SLIDE RAIL KIT THEREOF

(71) Applicants: King Slide Works Co., Ltd., Kaohsiung (TW); King Slide Technology Co., Ltd., Kaohsiung (TW)

(72) Inventors: Ken-Ching Chen, Kaohsiung (TW); Shun-Ho Yang, Kaohsiung (TW); Wei-Chen Chang, Kaohsiung (TW); Chun-Chiang Wang, Kaohsiung (TW)

(73) Assignees: King Slide Works Co., Ltd., Kaohsiung (TW); King Slide Technology Co., Ltd., Kaohsiung (TW)

( * ) Notice: Subject to any disclaimer, the term of this patent is extended or adjusted under 35 U.S.C. 154(b) by 0 days.

(21) Appl. No.: 18/508,846

(22) Filed: Nov. 14, 2023

(65) Prior Publication Data

US 2024/0423365 A1 Dec. 26, 2024

(30) Foreign Application Priority Data

Jun. 21, 2023 (TW) ..... 112123749

(51) Int. Cl.
*A47B 88/40* (2017.01)

(52) U.S. Cl.
CPC ..... *A47B 88/40* (2017.01)

(58) Field of Classification Search
CPC ..... A47B 88/40; A47B 88/43; H05K 7/1489; H05K 7/1401
See application file for complete search history.

(56) References Cited

U.S. PATENT DOCUMENTS

| | | | | |
|---|---|---|---|---|
| 6,935,710 | B2 * | 8/2005 | Chen | A47B 88/487 312/334.44 |
| 7,413,269 | B2 * | 8/2008 | Chen | A47B 88/493 312/334.47 |
| 7,744,175 | B2 * | 6/2010 | Peng | A47B 88/493 312/334.46 |
| 10,413,065 | B2 * | 9/2019 | Chen | A47B 88/487 |
| 11,641,939 | B2 | 5/2023 | Chen et al. | |
| 2005/0162052 | A1 * | 7/2005 | Chen | A47B 88/497 312/334.5 |
| 2007/0170830 | A1 * | 7/2007 | Huang | A47B 88/487 312/334.47 |
| 2009/0096340 | A1 * | 4/2009 | Chen | A47B 88/493 312/334.46 |

* cited by examiner

*Primary Examiner* — Ko H Chan
(74) *Attorney, Agent, or Firm* — Best & Flanagan LLP

(57) ABSTRACT

A slide rail assembly includes a first rail, a second rail, a working mechanism, an engaging member and an operating member. The second rail is movable relative to the first rail. The working mechanism and the engaging member are arranged on the second rail. When the second rail is moved to a predetermined position along a predetermined direction relative to the first rail, the working mechanism in a first state is configured to be blocked by a blocking feature of the first rail. When the operating member is moved from a first operating position to a second operating position, the working mechanism is driven to switch to a second state to be no longer blocked by the blocking feature. When the operating member is located at the second operating position, the operating member is engaged with the engaging member to be held at the second operation position.

18 Claims, 9 Drawing Sheets

SLIDE RAIL ASSEMBLY AND SLIDE RAIL KIT THEREOF

BACKGROUND OF THE INVENTION

1. Field of the Invention

The present invention relates to a slide rail assembly, and more particularly, to a slide rail assembly with a slide rail configured to be held at a predetermined operating position after an operating member being operated.

2. Description of the Prior Art

U.S. Pat. No. 6,935,710 B2 discloses a two-way retainer for a slide rail assembly comprising a retaining mechanism and a stop member respectively mounted on a first slide track and a second slide track. The retaining mechanism is at least arranged with two retaining arms and an elastic member abutting against each other. Each of the retaining arms is arranged with an inclined surface and correspondingly an engaging portion. The stop member is arranged with a stop portion. When the first slide track is pulled forward to move to a predetermined position, the stop portion of the stop member of the second slide track may pass through the inclined surface of one of the retaining arms of the first slide track to be engaged between the engaging portions of the two retaining arms for two-way positioning. A user can operate a linkage rod to a predetermined operating position in order to disengage the stop portion from the two retaining arms so as to undo two-way positioning.

The above patent discloses relevant technical features for two-way positioning of two slide rails. However, for different market requirements, it is important to develop various products.

SUMMARY OF THE INVENTION

The present invention aims to provide a slide rail assembly with an operating member. The present invention further provides a rack system and a slide rail kit with an operating member.

According to an embodiment of the present invention, a slide rail assembly comprises a first rail, a second rail, a third rail, a working mechanism, an engaging member and an operating member. The first rail comprises a blocking feature. The second rail is longitudinally movable relative to the first rail. The working mechanism and the engaging member are arranged on the second rail. The operating member is arranged on the second rail and configured to drive the working mechanism. The first rail is movably mounted between the third rail and the second rail, and the first rail is configured to extend a moving distance of the second rail relative to the third rail. When the second rail is moved to a predetermined position relative to the first rail along a first predetermined direction, the working mechanism in a first state is configured to be blocked by the blocking feature. The working mechanism comprises a pair of working members pivotally connected to the second rail, the pair of working members are configured to be held at the first state in response to elastic force of at least one elastic feature. When the operating member is moved from a first operating position to a second operating position, the working mechanism is driven by the operating member to switch to a second state to be no longer blocked by the blocking feature, such that the second rail is movable relative to the first rail from the predetermined position along the first predetermined direction to be detached from the first rail or along a second predetermined direction opposite to the first predetermined direction to be retracted relative to the first rail. When the operating member is located at the second operating position, the operating member is engaged with the engaging member to be held at the second operating position.

According to another embodiment of the present invention, a rack system comprises a rack, a carried object and a plurality of slide rail assemblies arranged on one side of the carried object and configured to mount the carried object to the rack. Each of the slide rail assemblies comprises a first rail, a second rail, a third rail, a working mechanism, an engaging member and an operating member. The first rail comprises a blocking feature. The second rail is movable relative to the first rail and configured to carry the carried object. The third rail is configured to be mounted to the rack. The working mechanism and the engaging member are arranged on the second rail, and the engaging member comprises an engaging part. The operating member is arranged on the second rail and configured to drive the working mechanism, and the operating member comprises an auxiliary feature. The first rail is movably mounted between the third rail and the second rail, and the first rail is configured to extend a moving distance of the second rail relative to the third rail. The working mechanism comprises a pair of working members pivotally connected to the second rail, and the pair of working members are configured to be held at a first state in response to elastic force of at least one elastic feature. When the operating member is located at a first operating position, the working mechanism is in the first state and corresponding to the blocking feature of the first rail; when the operating member is located at a second operating position, the working mechanism is in a second state and not corresponding to the blocking feature of the first rail. When the second rail is moved relative to the first rail along an opening direction to an extended position and when the operating member is located at the first operating position, the working mechanism and the blocking feature are configured to block each other. When the operating member is located at the second operating position, the working mechanism and the blocking feature no longer block each other such that the second rail is movable relative to the first rail from the predetermined position along the first predetermined direction to be detached from the first rail or along a second predetermined direction opposite to the first predetermined direction to be retracted relative to the first rail, and the auxiliary feature of the operating member is configured to engage with the engaging part of the engaging member in order to hold the operating member at the second operating position.

According to another embodiment of the present invention, a slide rail kit comprises a slide rail, a working mechanism, an engaging member and an operating member. The working mechanism and the engaging member are arranged on the slide rail. When the operating member is moved from a first operating position to a second operating position, the working mechanism is driven by the operating member to switch from a first state to a second state. When the operating member is located at the second operating position, the operating member is engaged with the engaging member to be held at the second operating position in order to hold the working mechanism at the second state.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
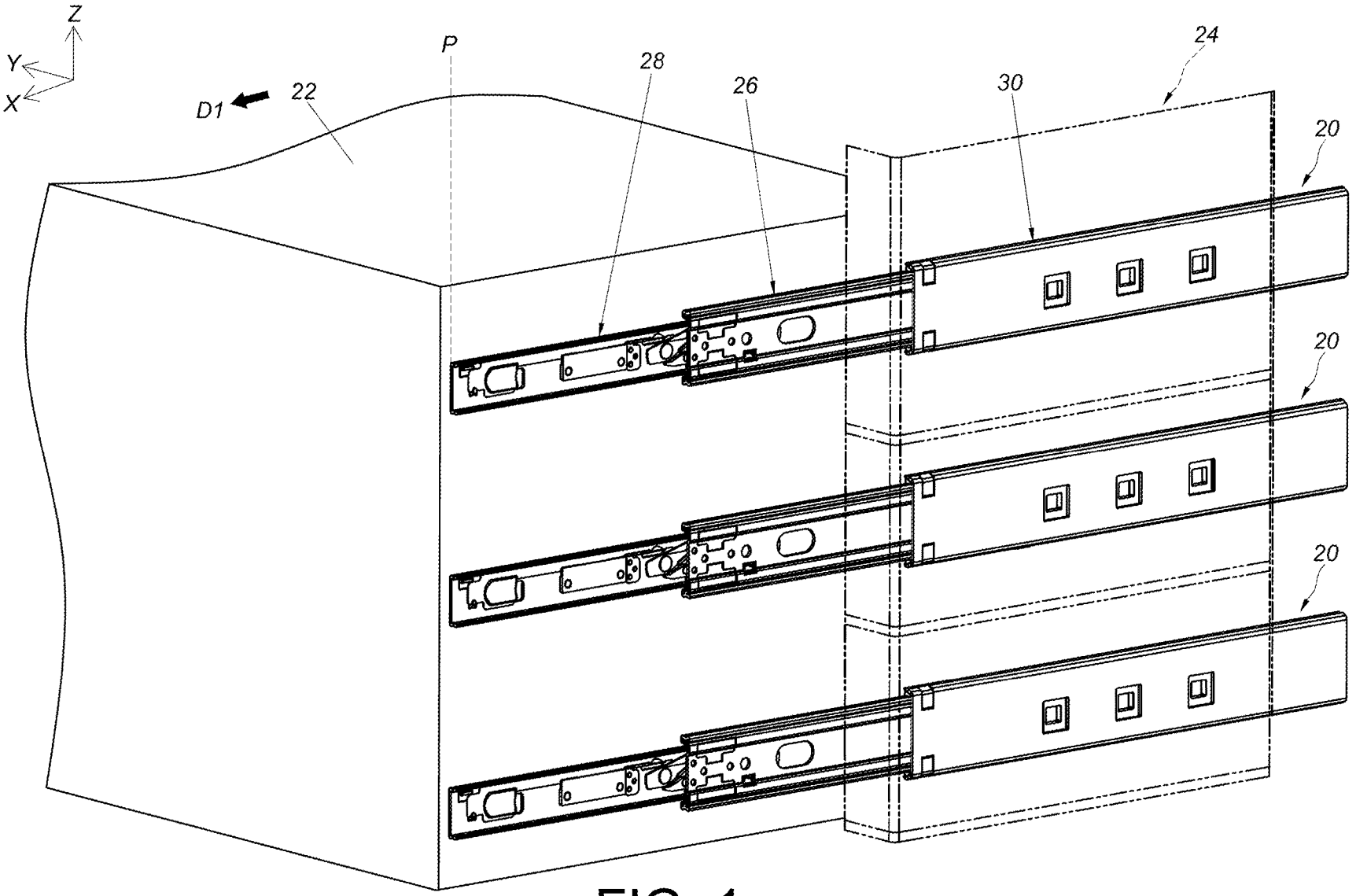
FIG. 1 is diagram showing a plurality of slide rail assemblies configured to mount a carried object to a rack according to a first embodiment of the present invention.

As shown in FIG. 1, a plurality of slide rail assemblies 20 configured to mount a carried object 22 to a rack 24 according to a first embodiment of the present invention. Each of the slide rail assemblies 20 has substantially the same structural configuration. For example, the slide rail assembly 20 comprises a first rail 26, a second rail 28 and a third rail 30. The first rail 26 is movably mounted between the third rail 30 and the second rail 28, and the first rail 26 is configured to extend a moving distance of the second rail 28 relative to the third rail 30. The third rail (such as an outer rail), the first rail (such as a middle rail) and the second rail 28 (such as an inner rail) are longitudinally movable relative to each other. In FIG. 1, the X axis is a longitudinal direction (or a length direction of the slide rail), the Y axis is a transverse direction (or a lateral direction of the slide rail), and the Z axis is a vertical direction (or a height direction of the slide rail).

Furthermore, the third rail 30 is configured to be fixedly mounted to the rack 24, and the second rail 28 is configured to carry the carried object 22. The second rail 28 of each of the slide rail assemblies 20 is able to be moved to a predetermined position P (such as an extended position) along a first predetermined direction D1 (such as an opening direction) relative to the first rail 26, such that at least one portion of the carried object 22 is located outside the rack 24.

Figure 2:
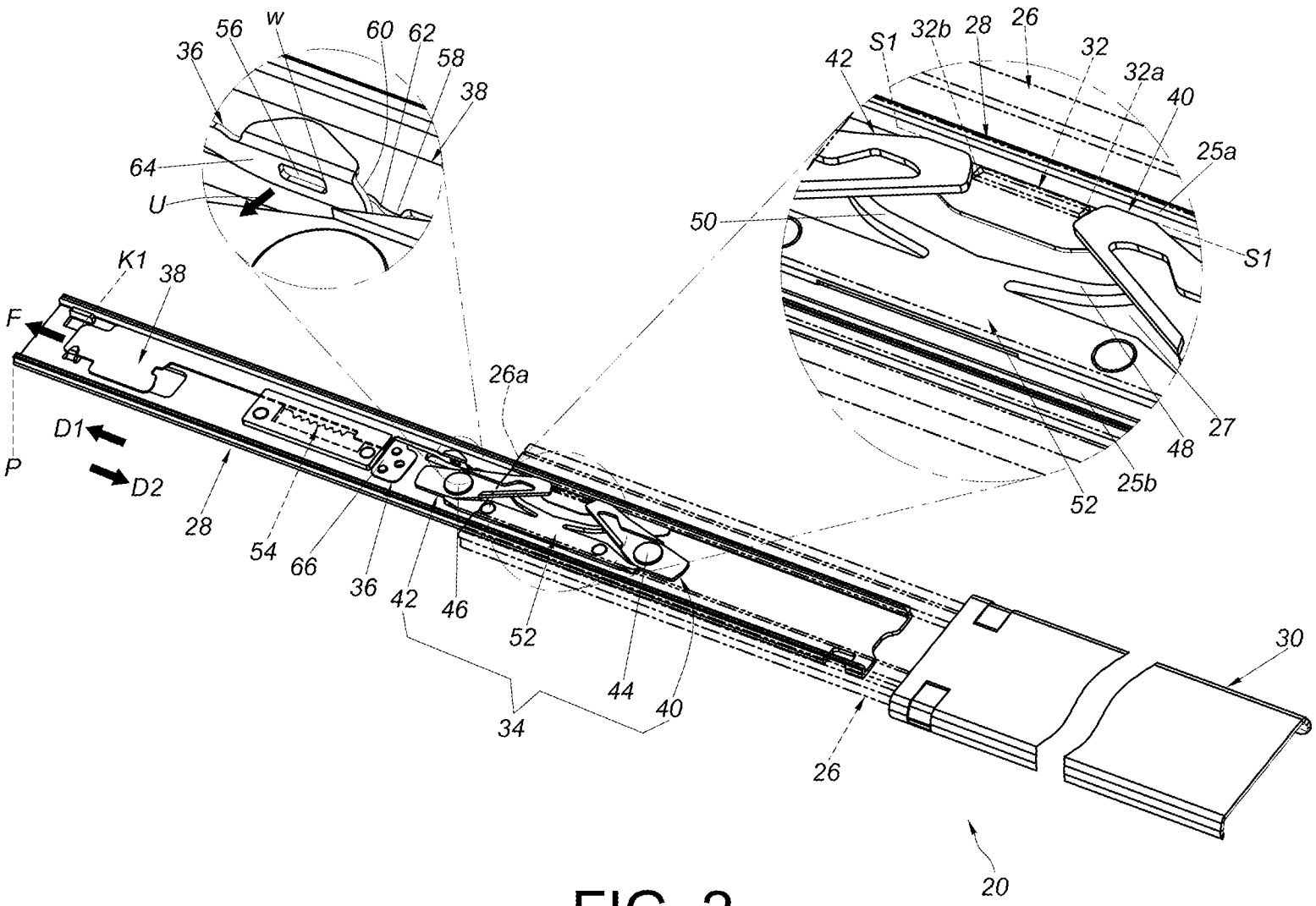
FIG. 2 is a diagram showing a second rail of a slide rail assembly being moved to a predetermined position relative to a first rail along a first predetermined direction according to the first embodiment of the present invention.

As shown in FIG. 2, the first rail 26 comprises a blocking feature 32. The blocking feature 32 is directly or indirectly arranged on the first rail 26. The blocking feature 32 is a protrusion in the present embodiment, but the present invention is not limited thereto. Preferably, the blocking feature 32 is arranged adjacent to an end part 26*a* of the first rail 26 (such as a front end part), but the present invention is not limited thereto. The slide rail assembly 20 further comprises a working mechanism 34, an engaging member 36 and an operating member 38. The working mechanism 34, the engaging member 36 and the operating member 38 are arranged on the second rail 28. The operating member 38 is configured to drive the working mechanism 34 to move. In the present embodiment, the operating member 38 is operatively connected to the working mechanism 34 and the engaging member 36. The second rail 28, the working mechanism 34, the engaging member 36 and the operating member 38 together form a slide rail kit.

When the second rail 26 is located at the predetermined position P relative to the first rail 26 and when the operating member 38 is located at a first operating position K1, the working mechanism 34 in a first state S1 is configured to be blocked by the blocking feature 32 of the first rail 26, in order to prevent the second rail 28 from being moved relative to the first rail 26 from the predetermined position P along the first predetermined direction D1 and/or a second predetermined direction D2 (such as a retracting direction) opposite to the first predetermined direction D1.

Preferably, the working mechanism 34 comprises a pair of working members, such as first working member 40 and a second working member 42 pivotally connected to the second rail 28 through a first shaft 44 and a second shaft 46 respectively.

Preferably, the slide rail assembly 20 further comprises at least one elastic feature, such as a first elastic feature 48 and a second elastic feature 50 integrated onto a base 52. The base 52 is arranged (such as fixed) on the second rail 28. Furthermore, the first working member 40 and the second working member 42 are configured to be held at the first state S1 in response to the elastic forces of the first elastic feature 48 and the second elastic feature 50 respectively, such that the first working member 40 and the second working member 42 are respectively blocked by two opposite ends of the blocking feature 32 of the first rail 26 (a first end 32*a* and a second end 32*b*, such as a rear end and a front end, of the blocking feature 32), in order to prevent the second rail 28 from being moved from the predetermined position P along the first predetermined direction D1 or the second predetermined direction D2.

Figure 3:
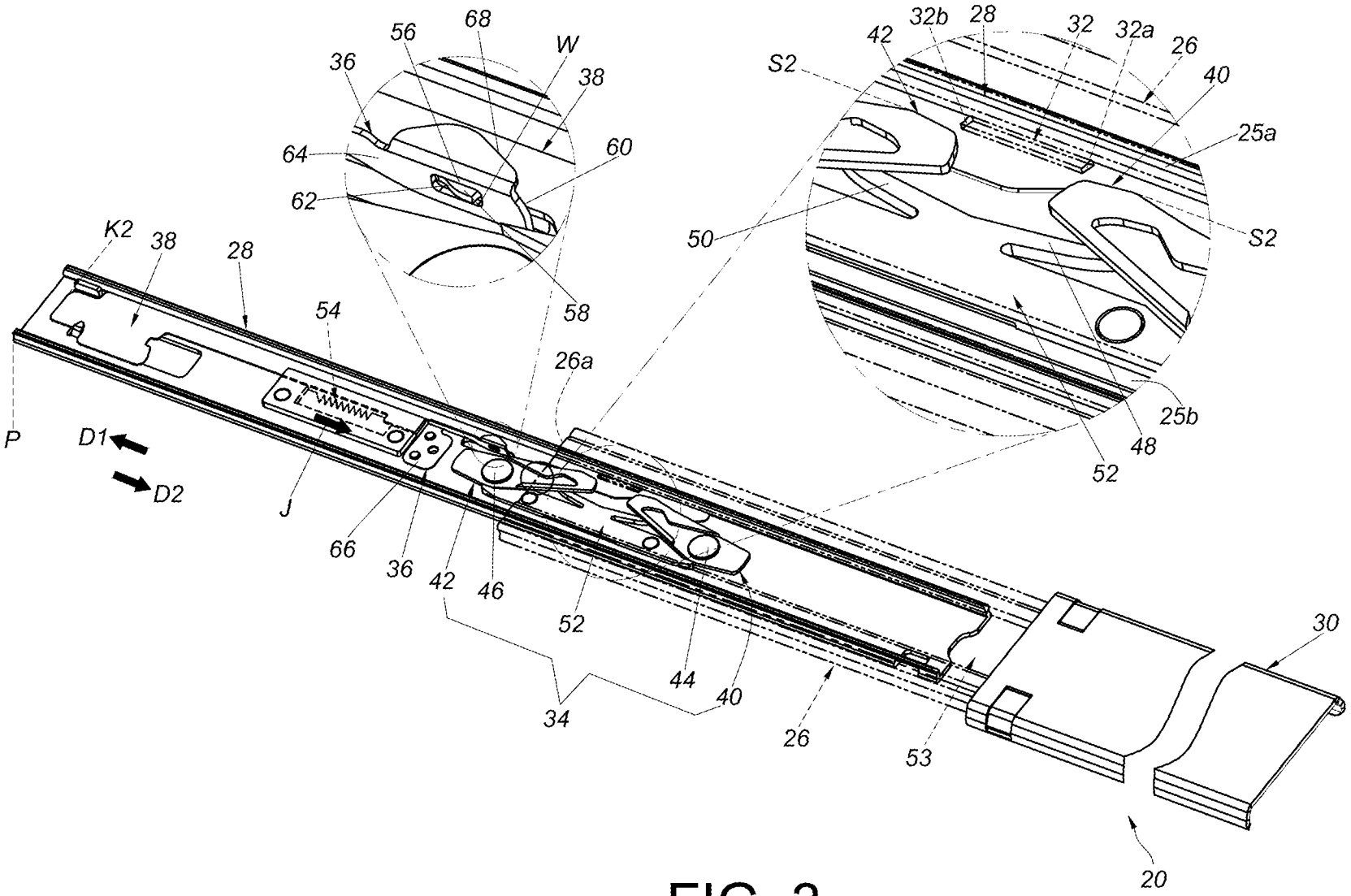
FIG. 3 is a diagram showing the second rail of the slide rail assembly located at the predetermined position relative to the first rail according to the first embodiment of the present invention.

As shown in FIG. 2 and FIG. 3, when the operating member 38 is located at the first operating position K1 (as shown in FIG. 2), the working mechanism 34 is in the first state S1 and corresponding to the blocking feature 32 of the first rail 26; when the operating member 38 is located at a second operating position K2 (as shown in FIG. 3), the working mechanism 34 is in a second state S2 and not corresponding to the blocking feature 32 of the first rail 26.

Furthermore, when a user applies a force F to move the operating member 38 from the first operating position K1 (as shown in FIG. 2) to a second operating position K2 (as shown in FIG. 3), the working mechanism 34 is driven by the operating member 38 to be switched (such as being rotated) from the first state S1 (as shown in FIG. 2) to a second state S2 (as shown in FIG. 3), such that the working mechanism 34 is no longer blocked by the blocking feature 32, in order to allow the second rail 28 to move from the predetermined position P along the first predetermined direction D1 or the second predetermined direction D2. For example, the second rail 28 can be moved from the predetermined position P along the first predetermined direction D1 to be detached from a passage 53 of the first rail 26; or the second rail 28 can be moved from the predetermined position P along the second predetermined direction D2 to be retracted relative to the first rail 26. Moreover, the first elastic feature 48 and the second elastic feature 50 are in a state of accumulating elastic forces in FIG. 3.

Particularly, when the operating member 38 is located at the second operating position K2, the operating member 38 is engaged with the engaging member 36, such that the operating member 38 is held at the second operating position K2 even the force F is no longer applied to the operating member 38. Therefore, the working mechanism 34 is held at the second state S2. In other words, the working mechanism 34 is held at a state being no longer blocked by the blocking feature 32 of the first rail 26 (as shown in FIG. 3), so as to increase operating convenience for the user.

Moreover, in the aforementioned environment of the plurality of slide rail assemblies 20 carrying the carried object 22 together, through using the technique of mutually engaging (positioning) the operating member 38 with the engaging member 36, the operating member 38 of each of the slide rail assemblies 20 can be held at the second operating position K2 even the user stops applying the force F to the operating member 38 (in other words, the user does not need to apply the force F to the operating member 38 continuously). As such, the working mechanism 34 on the second rail 28 of each of the slide rail assemblies 20 is held at a state being no longer blocked by the blocking feature 32 of the first rail 26. Therefore, the user can move the second rail 28 of each of the slide rail assemblies 20 from the predetermined P along position the first predetermined direction D1 to directly detach the second rail 28 from the passage 53 of the first rail 26 (in other words, the carried object 22 can be directly detached from the rack 24); or the user can move the second rail 28 of each of the slide rail assemblies 20 from the predetermined position P along the second predetermined direction D2 to retract the second rail 28 relative to the first rail 26, so as to increase operating convenience for the user.

Preferably, the slide rail assembly 20 further comprises a return elastic member 54 configured to provide an elastic force to the operating member 38. When the operating member 38 is located at the second operating position K2, the return elastic member 54 is in a state of accumulating a return elastic force J (as shown in FIG. 3).

Preferably, the engaging member 36 comprises an engaging part 56, and the operating member 38 comprises an auxiliary feature 58. The engaging part 56 can be a hole surrounded and defined by a plurality of wall W, and the auxiliary feature 58 can be a hook or a hook-shaped object, but the present invention is not limited thereto. When the operating member 38 is located at the second operating position K2, the auxiliary feature 58 of the operating member 38 is engaged with the engaging part 56 of the engaging member 36, so as to hold the operating member 38 at the second operating position K2 (as shown in FIG. 3).

Preferably, one of the engaging member 36 and the operating member 38 comprises a guiding part. In the present embodiment, the engaging member 36 and the operating member 38 comprise a first guiding part 60 and a second guiding part 62 respectively, and each of the first guiding part 60 and the second guiding part 62 has an inclined surface or an arc surface. Moreover, during a process of the operating member 38 being moved from the first operating position K1 to a second operating position K2, the operating member 38 is configured to contact the first guiding part 60 of the engaging member 36 through the second guiding part 62, so as to guide the auxiliary feature 58 of the operating member 38 to be engaged with the engaging part 56 of the engaging member 36.

Preferably, the engaging member 36 further comprises an elastic arm 64, and the elastic arm 64 is arranged with the engaging part 56. During the process of the operating member 38 being moved from the first operating position K1 to the second operating position K2, the operating member 38 is configured to contact the first guiding part 60 of the engaging member 36 through the second guiding part 62, so as to drive the elastic arm to deflect along a height direction U (the downward height direction U shown in FIG. 2), such that the elastic arm 64 accumulates an elastic force. When the auxiliary feature 58 corresponds to the engaging part 56 of the engaging member 36, the elastic arm 64 releases the elastic force, such that the auxiliary feature 58 is engaged with the engaging part 56 of the engaging member 36 (as shown in FIG. 3)

Preferably, the engaging member 36 is elastic. Moreover, the engaging member 36 further comprises a connecting part 66 fixed to the second rail 28, and the elastic arm 64 is extended a predetermined longitudinal length from the connecting part 66.

Preferably, the second rail 28 comprises a first wall 25*a*, a second wall 25*b* and a longitudinal wall 27 connected between the first wall 25*a* and the second wall 25*b* of the second rail 28. When the working mechanism 34 is in the first state S1, the working mechanism 34 is adjacent to the first wall 25*a* of the second rail 28 (as shown in FIG. 2); when the working mechanism 34 is in the second state S2, the working mechanism 34 is away from the first wall 25*a* of the second rail 28 (as shown in FIG. 3).

Figure 4:
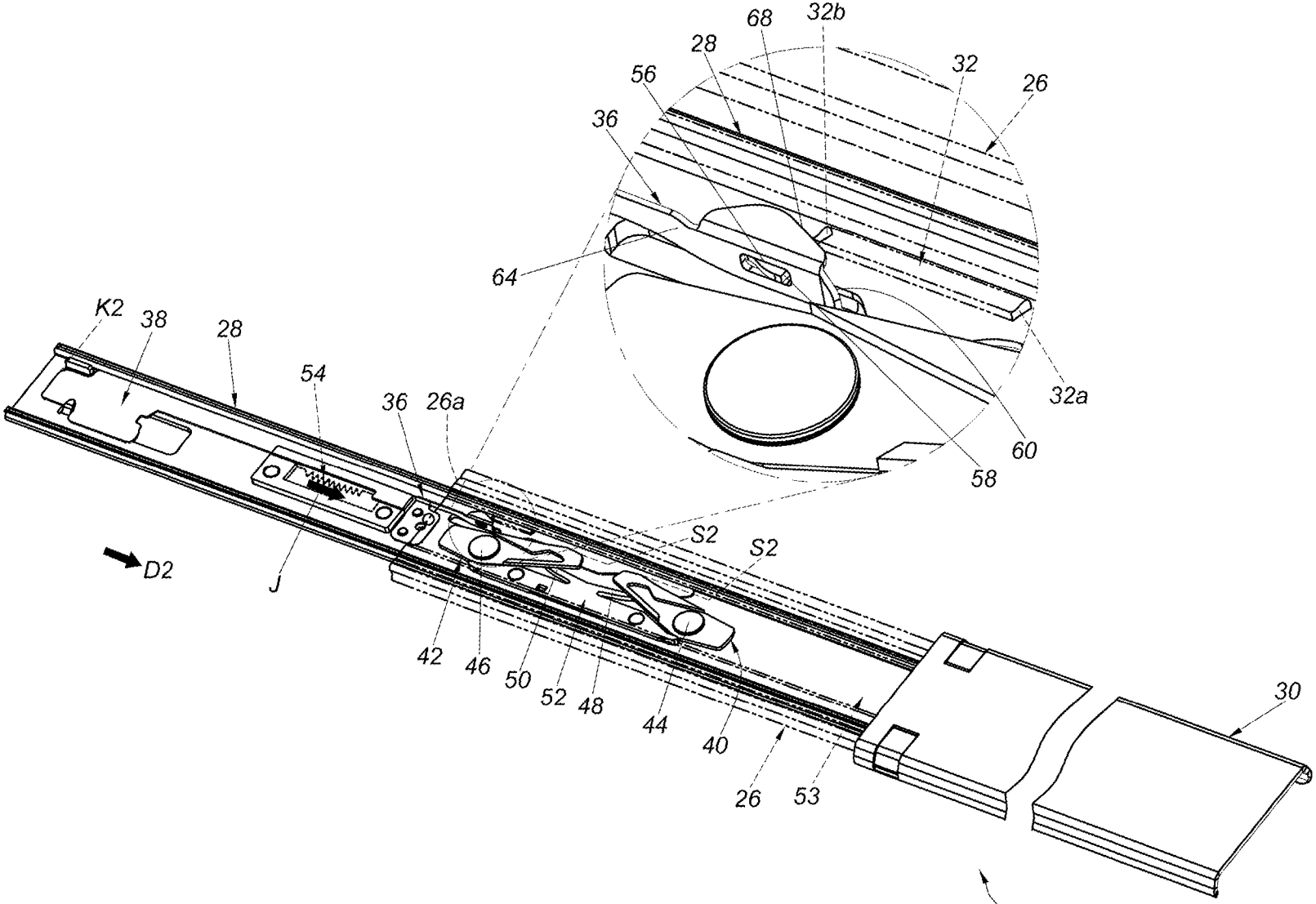
FIG. 4 is a diagram showing the second rail of the slide rail assembly being moved relative to the first rail along a second predetermined direction according to the first embodiment of the present invention.
Figure 5:
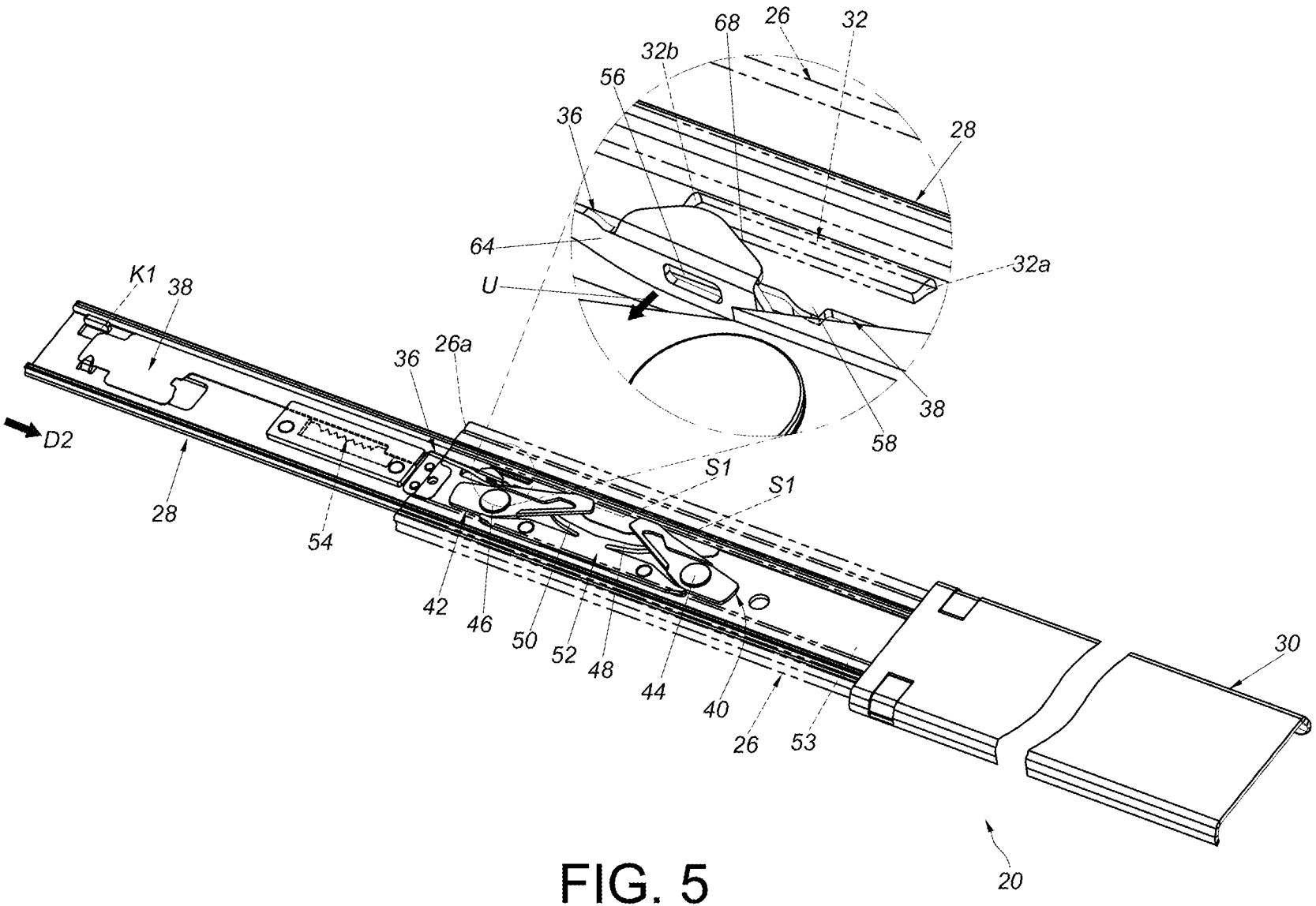
FIG. 5 is a diagram showing the second rail of the slide rail assembly being further moved relative to the first rail along the second predetermined direction according to the first embodiment of the present invention.

As shown in FIG. 3, FIG. 4 and FIG. 5, the engaging member 36 further comprises a disengaging part 68 corresponding to the blocking feature 32 of the first rail 26. The disengaging part 68 has an inclined surface or an arc surface. Preferably, the elastic arm 64 is arranged with the disengaging part 68. When the second rail 28 is moved from the predetermined position P along the second predetermined direction D2 relative to the first rail 26 (as shown in FIG. 3), the elastic arm 64 of the engaging member 36 is configured to be deflected by a predetermined angle along the height direction U (such as being deflected downward by the predetermined angle shown in FIG. 5) through mutual contact between the blocking feature 32 (the second end 32*b* of the blocking feature 32) of the first rail 26 and the disengaging part 68 of the engaging member 36, in order to disengage the auxiliary feature 58 of the operating member 38 from the engaging part 56 of the engaging member 36. Meanwhile, the return elastic member 54 is configured to release the return elastic force J along the second predetermined direction D2, such that the operating member 38 is driven to return to the first operating position K1 (as shown in FIG. 5) from the second operating position K2 (as shown in FIG. 4) in response to the return elastic force J. Accordingly, the first elastic feature 48 and the second elastic feature 50 are configured to release the elastic forces, and the first working member 40 and the second working member 42 are held at the first state S1 again (as shown in FIG. 5) in response to the elastic forces released by the first elastic feature 48 and the second elastic feature 50.

Figure 6:
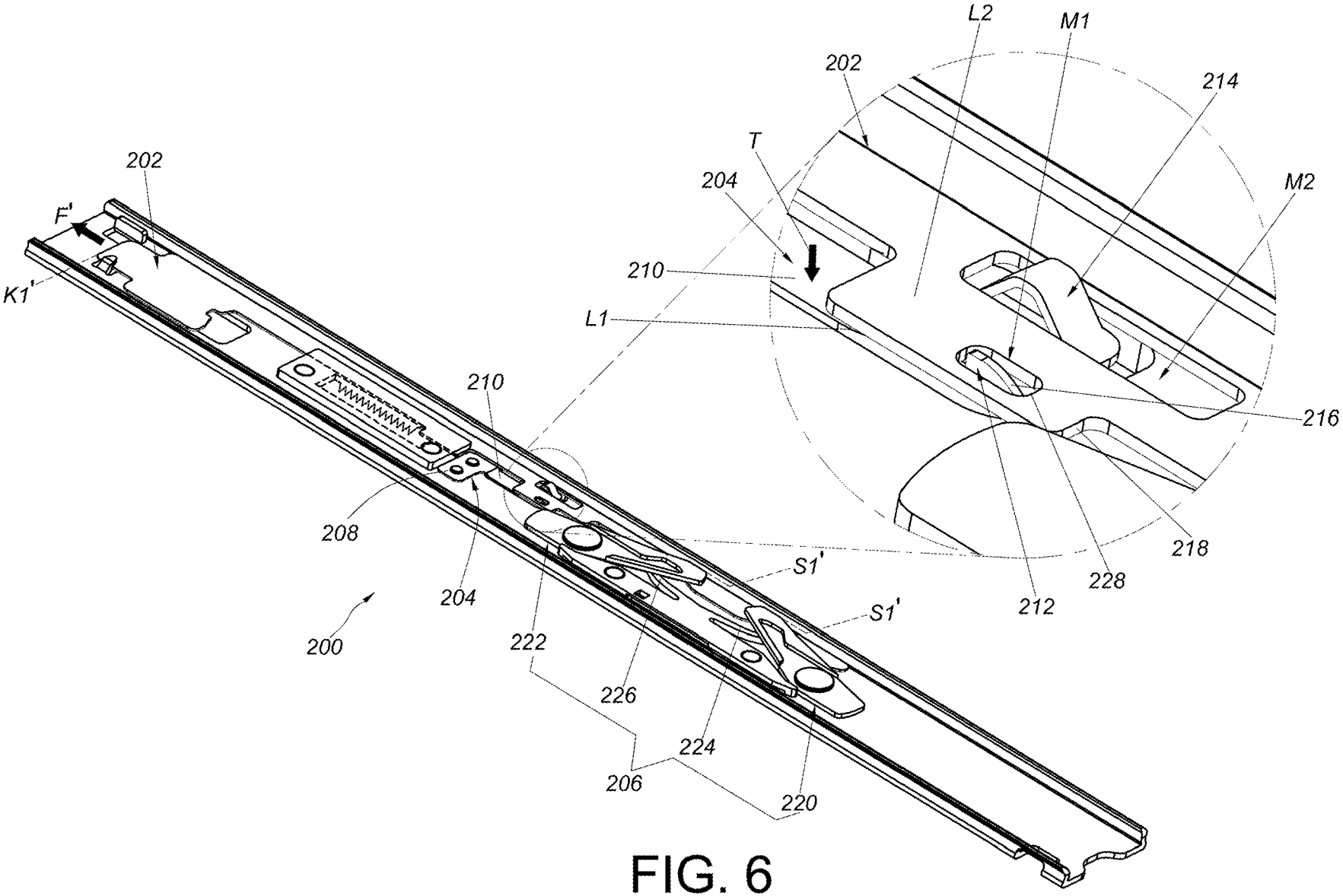
FIG. 6 is a diagram showing an operating member of a second rail of a slide rail assembly located at a first operating position according to a second embodiment of the present invention.
Figure 7:
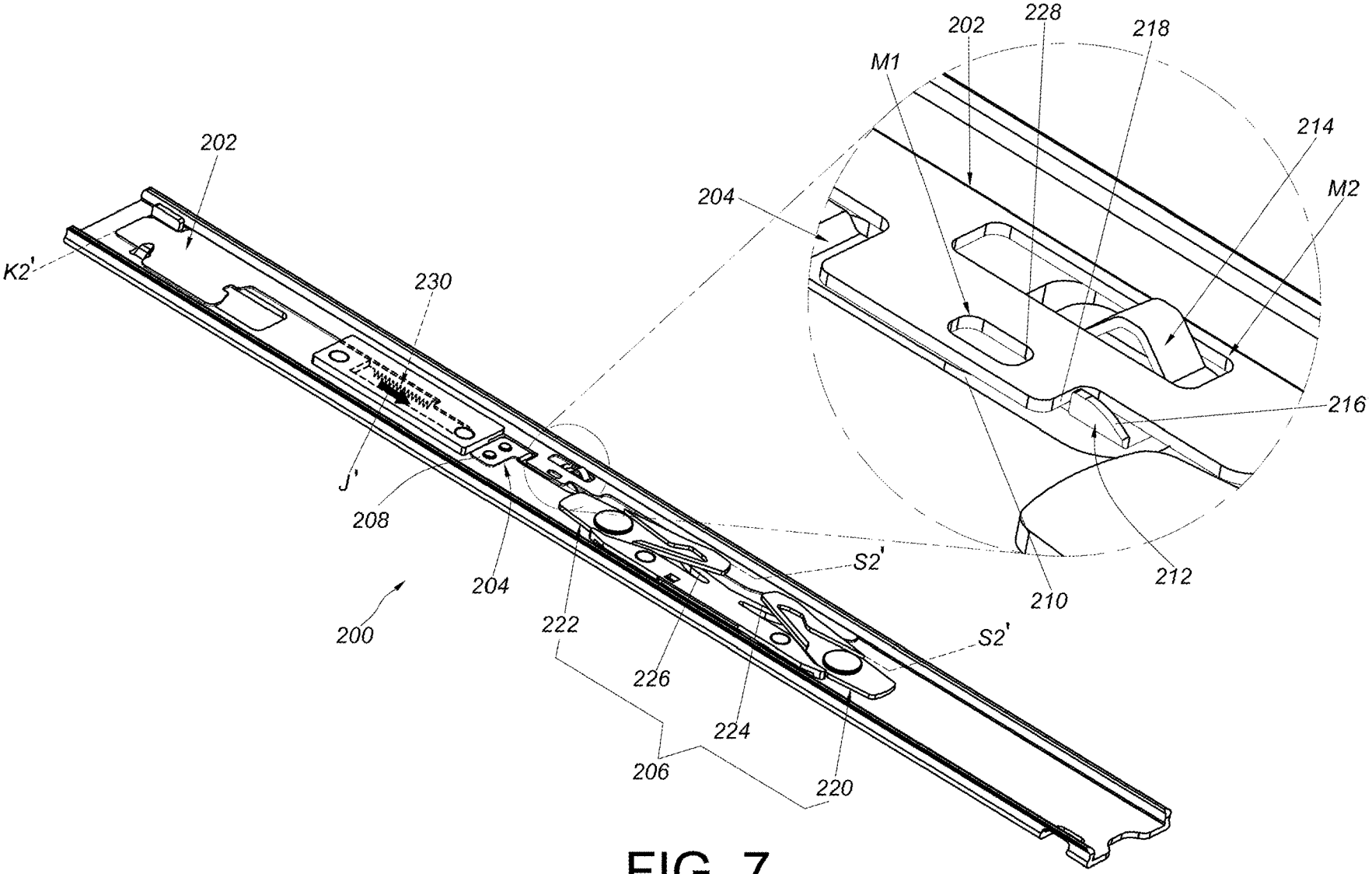
FIG. 7 is a diagram showing the operating member of the second rail of the slide rail assembly being held at a second operating position according to the second embodiment of the present invention.

FIG. 6 and FIG. 7 show a second rail 200 of a slide rail assembly according to a second embodiment of the present invention. Similar to the first embodiment, when the user applies a force F' to move an operating member 202 of the second embodiment from a first operating position K1' (as shown in FIG. 6) to a second operating position K2' (as shown in FIG. 7), the operating member 202 is configured to be engaged with an engaging member 204, so as to hold the operating member 202 at the second operating position K2', in order to hold a working mechanism 206 in a second state S2' (as shown in FIG. 7).

A difference between the second embodiment and the first embodiment substantially lies in structural configuration and interactive relationship between the operating member 202 and the engaging member 204.

Furthermore, the engaging member 204 comprises a connecting part 208, an elastic arm 210, an engaging part 212 and a disengaging part 214. The connecting part 208 is fixed to the second rail 200. The elastic arm 210 is extended a predetermined longitudinal length from the connecting part 208. The elastic arm 210 is arranged with the engaging part 212 and the disengaging part 214. The engaging part 212 can be a hook or a hook-shaped object, but the present invention is not limited thereto.

Preferably, the engaging part 212 of the engaging member 204 is arranged with an auxiliary guiding section 216, and the auxiliary guiding section 216 has an inclined surface or an arc surface.

Preferably, the disengaging part 214 has an inclined surface or an arc surface.

On the other hand, the operating member 202 comprises an auxiliary feature 218, and the auxiliary feature 218 has a vertical wall, but the present invention is not limited thereto. When the operating member 202 is located at the second operating position K2', the auxiliary feature 218 of the operating member 202 is configured to be engaged with the engaging part 212 of the engaging member 204, so as to hold the operating member 202 at the second operating position K2' (as shown in FIG. 7).

Preferably, the operating member 202 is formed with a first space M1. The engaging part 212 of the engaging member 204 is configured to penetrate through the operating member 202 from a first side L1 of the operating member 202 to a second side L2 of the operating member 202 through the first space M1. The first side L1 and the second side L2 are two opposite sides (as shown in FIG. 6).

The operating member 202 is further formed with a second space M2. The disengaging part 214 of the engaging member 204 is configured to penetrate through the operating member 202 from the first side L1 of the operating member 202 to the second side L2 of the operating member 202 through the second space M2 (as shown in FIG. 6).

When the user applies a force F' to the operating member 202 to move the operating member 202 from the first operating position K1' (as shown in FIG. 6) to the second operating position K2' (as shown in FIG. 7), the working mechanism 206 (such as a first working member 220 and a second working member 222 of the working mechanism 206) is driven by the operating member 202 to be switched (such as being rotated) from a first state S1' (as shown in FIG. 6) to a second state S2' (as shown in FIG. 7), such that the working mechanism is no longer blocked by the blocking feature 32 of the first rail 26, so as to allow the second rail 200 to move from the predetermined position P along the first predetermined direction D1 and the second predetermined direction D2 relative to the first rail 26. Such configuration is identical to the first embodiment, for simplification, no further illustration is provided. In addition, a first elastic feature 224 and a second elastic feature 226 are in a state of accumulating elastic forces in FIG. 7.

Particularly, when the operating member 202 is located at the second operating position K2', the operating member 202 is engaged with the engaging member 204, such that the operating member 202 is held at the second operating position K2' even the force F' is no longer applied to the operating member 202. Therefore, the working mechanism 206 is held at the second state S2'. In other words, the working mechanism 206 is held at a state being no longer blocked by the blocking feature 32 of the first rail 26 (as shown in FIG. 7), so as to increase operating convenience for the user.

Preferably, when the operating member 202 is located at the second operating position K2', the auxiliary feature 218 of the operating member 202 is engaged with the engaging part 212 of the engaging member 204, so as to hold the operating member 202 at the second operating position K2'.

Preferably, during a process of the operating member 202 being moved from the first operating position K1' to the second operating position K2', the elastic arm 210 is configured to be deflected along a transverse direction T (the transverse direction T shown in FIG. 6) through mutual contact between the auxiliary guiding section 216 of the engaging member 204 and the operating member 202 (an inner wall 228 in the first space M1), such that the elastic arm 210 accumulates an elastic force. When the auxiliary feature 218 corresponds to the engaging part 212 of the engaging member 204, the elastic arm 210 releases the elastic force, such that the auxiliary feature 218 of the operating member 202 is engaged with the engaging part 212 of the engaging member 204 (as shown in FIG. 7).

More particularly, similar to the first embodiment, the disengaging part 214 of the engaging member 204 of the second embodiment corresponds to the blocking feature 32 (the second end 32*b* of the blocking feature 32) of the first rail 26. When the second rail 200 is moved from the predetermined position P along the second predetermined direction D2 relative to the first rail 26, the elastic arm 210 of the engaging member 204 is configured to be deflected by a predetermined angle along the transverse direction T through mutual contact between the blocking feature 32 (the second end 32*b* of the blocking feature 32) of the first rail 26 and the disengaging part 214 of the engaging member 204, in order to disengage the auxiliary feature 218 of the operating member 202 from the engaging part 212 of the engaging member 204. Meanwhile, a return elastic member 230 is configured to release a return elastic force J' along the second predetermined direction D2, such that the operating member 202 is driven to return to the first operating position K1' (as shown in FIG. 6) from the second operating position K2' (as shown in FIG. 7) in response to the return elastic force J'. Accordingly, the first elastic feature 224 and the second elastic feature 226 are configured to release the elastic forces, and the working mechanism 206 (the first working member 40 and the second working member 42) is held at the first state S1' again (as shown in FIG. 6) in response to the elastic forces released by the first elastic feature 224 and the second elastic feature 226.

Figure 8:
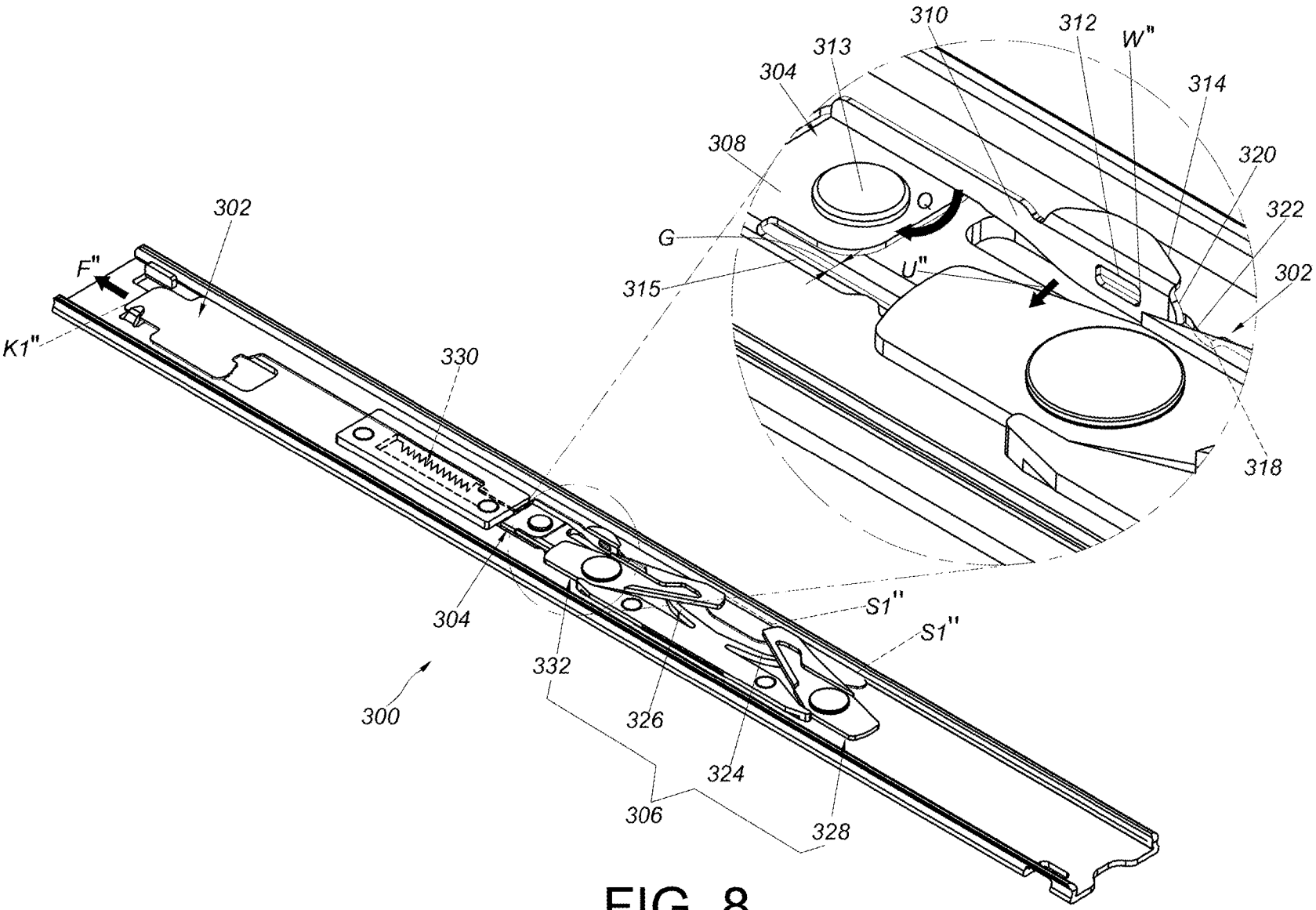
FIG. 8 is a diagram showing an operating member of a second rail of a slide rail assembly located at a first operating position according to a third embodiment of the present invention.
Figure 9:
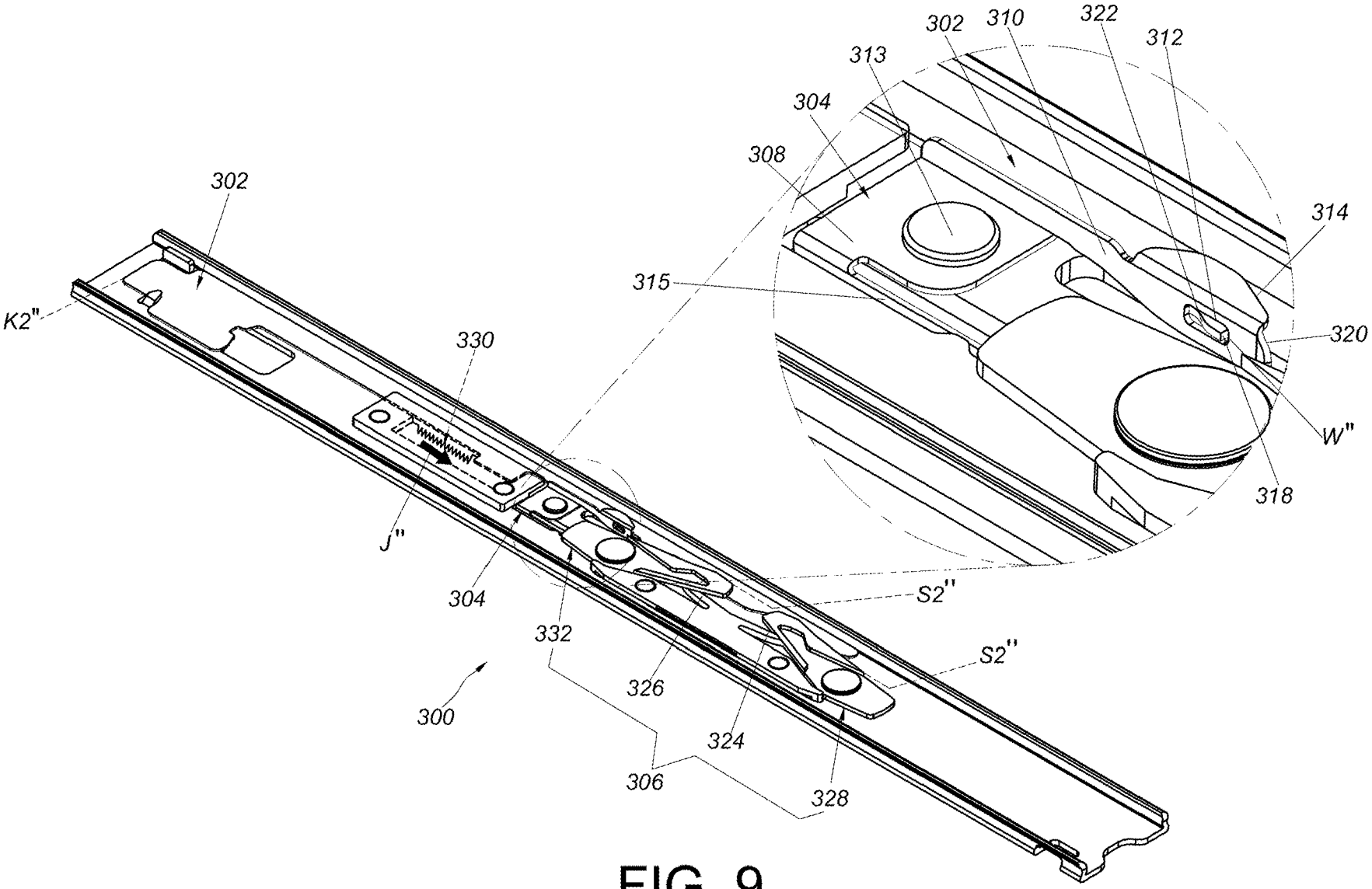
FIG. 9 is a diagram showing the operating member of the second rail of the slide rail assembly being held at a second operating position according to the third embodiment of the present invention.

FIG. 8 and FIG. 9 show a second rail 300 of a slide rail assembly according to a third embodiment of the present invention. Similar to the first embodiment, when the user applies a force F" to move an operating member 302 of the second embodiment from a first operating position K1" (as shown in FIG. 8) to a second operating position K2" (as shown in FIG. 9), the operating member 302 is configured to be engaged with an engaging member 304, so as to hold the operating member 302 at the second operating position K2", in order to hold a working mechanism 306 in a second state S2" (as shown in FIG. 9).

A difference between the third embodiment and the first embodiment substantially lies in structural configuration and interactive relationship between the operating member 302 and the engaging member 304.

Furthermore, the engaging member 304 comprises a connecting part 308, an elastic arm 310, an engaging part 312 and a disengaging part 314. Preferably, the engaging member 304 further comprises a supporting part 315. The connecting part 308 is movably mounted to the second rail 300. In the present embodiment, the connecting part 308 is pivotally connected to the second rail 300 through an auxiliary shaft 313. The elastic arm 310 is extended a predetermined longitudinal length from a top portion of the connecting part 308. The elastic arm 310 is arranged with the engaging part 312 and the disengaging part 314. The supporting part 315 is extended a predetermined longitudinal length from a bottom portion of the connecting part 308. The supporting part 315 and the elastic arm 310 are substantially parallel to each other. The supporting part 315 and the second rail 300 are configured to support and abut against each other, in order to increase stability of positioning the engaging member 304. A predetermined gap G is defined between the supporting part 315 and connecting part 308 (as shown in FIG. 8).

Preferably, the engaging part 312 can be a hole surrounded and defined by a plurality of wall W", and an auxiliary feature 318 of the operating member 302 can be a hook or a hook-shaped object, but the present invention is not limited thereto.

Preferably, the disengaging part 314 has an inclined surface or an arc surface.

Preferably, one of the engaging member 304 and the operating member 302 comprises a guiding part. In the present embodiment, the engaging member 304 and the operating member 302 comprise a first guiding part 320 and a second guiding part 322 respectively, and each of the first guiding part 320 and the second guiding part 322 has an inclined surface or an arc surface.

When the operating member 302 is located at the second operating position K2", the auxiliary feature 318 of the operating member 302 is engaged with the engaging part 312 of the engaging member 304, so as to hold the operating member 302 at the second operating position K2" (as shown in FIG. 9).

When the user applies the force F" to the operating member 302 to move the operating member 302 from the first operating position K1" (as shown in FIG. 8) to the second operating position K2" (as shown in FIG. 9), the working mechanism 306 (such as a first working member 328 and a second working member 332 of the working mechanism 306) is driven by the operating member 302 to be switched (such as being rotated) from the first state (as shown in FIG. 2) to a second state (as shown in FIG. 3), such that the working mechanism 306 is no longer blocked by the blocking feature 32 of the first rail 26, in order to allow the rail 300 to move from the predetermined position P along the first predetermined direction D1 or the second predetermined direction D2. Such configuration is identical to the first embodiment, for simplification, no further illustration is provided. In addition, a first elastic feature 324 and a second elastic feature 326 are in a state of accumulating elastic forces in FIG. 9.

Particularly, when the operating member 302 is located at the second operating position K2", the operating member 302 is engaged with the engaging member 304, such that the operating member 302 is held at the second operating position K2" even the force F" is no longer applied to the operating member 302. Therefore, the working mechanism 306 is held at the second state S2". In other words, the working mechanism 306 is held at a state being no longer blocked by the blocking feature 32 of the first rail 26 (as shown in FIG. 9), so as to increase operating convenience for the user.

Preferably, when the operating member 302 is located at the second operating position K2", the auxiliary feature 318 of the operating member 302 is engaged with the engaging part 312 of the engaging member 304, so as to hold the operating member 302 at the second operating position K2".

Preferably, during a process of the operating member 302 being moved from the first operating position K1" to the second operating position K2", the elastic arm 310 is configured to be deflected along a height direction U" (the downward height direction U" shown in FIG. 8) through the second guiding part 322 of the operating member 302 contacting the first guiding part 320 of the engaging member 304, so as to drive the connecting part 308 of the engaging member 304 to rotate toward the supporting part 315 along a predetermined moving direction Q to provide a buffering effect, in order to prevent deformation or damage of the engaging member 304 due to excessive force. Meanwhile, the elastic arm accumulates an elastic force. When the auxiliary feature 318 of the operating member 302 corresponds to the engaging part 312 of the engaging member 304, the elastic arm releases the elastic force, such that the auxiliary feature 318 is engaged with the engaging part 312 of the engaging member 304 (as shown in FIG. 9).

More particularly, similar to the first embodiment, the disengaging part 314 of the engaging member 304 of the third embodiment corresponds to the blocking feature 32 (the second end 32*b* of the blocking feature 32) of the first rail 26. When the second rail 300 is moved from the predetermined position P along the second predetermined direction D2 relative to the first rail 26, the elastic arm 310 of the engaging member 304 is configured to be deflected by a predetermined angle along the height direction U" through mutual contact between the blocking feature 32 (the second end 32*b* of the blocking feature 32) of the first rail 26 and the disengaging part 314 of the engaging member 304, in order to disengage the auxiliary feature 318 of the operating member 302 from the engaging part 312 of the engaging member 304. Meanwhile, a return elastic member 330 is configured to release a return elastic force J" along the second predetermined direction D2, such that the operating member 302 is driven to return to the first operating position K1" (as shown in FIG. 8) from the second operating position K2" (as shown in FIG. 9) in response to the return elastic force J". Accordingly, the first elastic feature 324 and the second elastic feature 326 are configured to release the elastic forces, and the working mechanism 306 (the first working member 328 and the second working member 332) is held at the first state S1" again (as shown in FIG. 8) in response to the elastic forces released by the first elastic feature 324 and the second elastic feature 326.

Therefore, the slide rail assembly and the slide rail kit according to the embodiments of the present invention have the following technical features:

1. Different from the linkage rod of the prior art which cannot be held at a predetermined operating position after being operated by the user, the operating member 38, 202, 302 of the first to third embodiments of the present invention can be held at the second operating position K2, K2', K2" through mutual engagement between the engaging member 36, 202, 302 and the operating member 38, 202, hold the working mechanism 34, 206, 306 at the second state S2, S2', S2". As such, the working mechanism 34, 206, 306 is held at a state being no longer blocked by the blocking feature 32 of the first rail 26. Therefore, the second rail 28, 200, 300 can be moved from the predetermined position P along the first predetermined direction D1 to be detached from the first rail 20 or moved from the predetermined position along the second predetermined direction D2 to be retracted relative to the first rail 20, so as to increase operating convenience for the user (single person) to operate alone.

2. In the first embodiment, the engaging member 36 is connected (fixed) to the second rail 28 through the connecting part 66, and the moving direction of the elastic arm 64 of the engaging member 36 is the height direction U relative to the second rail 28; in the second embodiment, the engaging member 204 is connected (fixed) to the second rail 28 through the connecting part 208, and the moving direction of the elastic arm 210 of the engaging member 204 is the transverse direction T relative to the second rail 200; in the third embodiment, the engaging member 304 is movably mounted (pivotally connected) to the second rail 300 through the connecting part 308.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A slide rail assembly, comprising:

a first rail comprising a blocking feature;

a second rail longitudinally movable relative to the first rail;

a third rail;

a working mechanism and an engaging member arranged on the second rail; and an operating member arranged on the second rail and configured to drive the working mechanism;

wherein the first rail is movably mounted between the third rail and the second rail, and the first rail is configured to extend a moving distance of the second rail relative to the third rail;

wherein when the second rail is moved to a predetermined position relative to the first rail along a first predetermined direction, the working mechanism in a first state is configured to be blocked by the blocking feature;

wherein the working mechanism comprises a pair of working members pivotally connected to the second rail, the pair of working members are configured to be held at the first state in response to elastic force of at least one elastic feature;

wherein when the operating member is moved from a first operating position to a second operating position, the working mechanism is driven by the operating member to switch to a second state to be no longer blocked by the blocking feature, such that the second rail is movable relative to the first rail from the predetermined position along the first predetermined direction to be detached from the first rail or along a second predetermined direction opposite to the first predetermined direction to be retracted relative to the first rail;

wherein when the operating member is located at the second operating position, the operating member is engaged with the engaging member without the engaging member providing an elastic force to the operating member toward the first operating position, in order to stop and hold the operating member at the second operating position by the engaging member.

2. The slide rail assembly of claim 1, further comprising a return elastic member configured to provide elastic force to the operating member.

3. The slide rail assembly of claim 1, wherein the engaging member comprises an engaging part, and the operating member comprises an auxiliary feature; wherein when the operating member is located at the second operating position, the auxiliary feature is configured to engage with the engaging part of the engaging member to hold the operating member at the second operating position.

4. The slide rail assembly of claim 3, wherein the engaging member further comprises a disengaging part corresponding to the blocking feature of the first rail; wherein when the second rail is moved relative to the first rail along the second predetermined direction, the operating member is disengaged from the engaging member through mutual contact between the blocking feature of the first rail and the disengaging part of the engaging member.

5. The slide rail assembly of claim 4, wherein the engaging member further comprises an elastic arm, and the elastic arm is arranged with the engaging part and the disengaging part.

6. The slide rail assembly of claim 5, wherein the engaging member further comprises a connecting part fixed to the second rail, and the elastic arm is extended from the connecting part.

7. The slide rail assembly of claim 6, wherein the elastic arm is configured to move along a height direction or a transverse direction of the slide rail assembly.

8. The slide rail assembly of claim 5, wherein the engaging member further comprises a connecting part movably mounted to the second rail, and the elastic arm is extended from the connecting part.

9. The slide rail assembly of claim 8, wherein the connecting part is pivotally connected to the second rail.

10. A rack system, comprising:

a rack;

a carried object; and a plurality of slide rail assemblies arranged on one side of the carried object and configured to mount the carried object to the rack, each of the slide rail assemblies comprising:

a first rail comprising a blocking feature;

a second rail movable relative to the first rail and configured to carry the carried object;

a third rail configured to be mounted to the rack;

a working mechanism and an engaging member arranged on the second rail, wherein the engaging member comprises an engaging part; and an operating member arranged on the second rail and configured to drive the working mechanism, the operating member comprising an auxiliary feature;

wherein the first rail is movably mounted between the third rail and the second rail, and the first rail is configured to extend a moving distance of the second rail relative to the third rail;

wherein the working mechanism comprises a pair of working members pivotally connected to the second rail, the pair of working members are configured to be held at a first state in response to elastic force of at least one elastic feature;

wherein when the operating member is located at a first operating position, the working mechanism is in the first state and corresponding to the blocking feature of the first rail; when the operating member is located at a second operating position, the working mechanism is in a second state and not corresponding to the blocking feature of the first rail;

wherein when the second rail is moved relative to the first rail along an opening direction to an extended position and when the operating member is located at the first operating position, the working mechanism and the blocking feature are configured to block each other;

wherein when the operating member is located at the second operating position, the working mechanism and the blocking feature no longer block each other such that the second rail is movable relative to the first rail from the predetermined position along the first predetermined direction to be detached from the first rail or along a second predetermined direction opposite to the first predetermined direction to be retracted relative to the first rail, and the auxiliary feature of the operating member is configured to engage with the engaging part of the engaging member in order to hold the operating member at the second operating position.

11. The rack system of claim 10, further comprising a return elastic member configured to provide elastic force to the operating member.

12. The rack system of claim 10, wherein the engaging member further comprises a disengaging part corresponding to the blocking feature of the first rail; wherein when the second rail is moved relative to the first rail along a retracted direction, the auxiliary feature of the operating member is disengaged from the engaging part of the engaging member through mutual contact between the blocking feature of the first rail and the disengaging part of the engaging member.

13. The rack system of claim 12, wherein the engaging member is fixedly or movably connected to the second rail.

14. The rack system of claim 13, wherein the second rail is longitudinally movable relative to the first rail, the engaging member further comprises an elastic arm, and the elastic arm is arranged with the engaging part and the disengaging part.

15. The rack system of claim 14, wherein the elastic arm is configured to move along a height direction or a transverse direction of the slide rail assembly.

16. A slide rail kit, comprising:

a slide rail;

a working mechanism and an engaging member arranged on the slide rail; and an operating member;

wherein when the operating member is moved from a first operating position to a second operating position, the working mechanism is driven by the operating member to switch from a first state to a second state;

wherein when the operating member is located at the second operating position, the operating member is engaged with the engaging member without the engaging member providing an elastic force to the operating member toward the first operating position, in order to stop and hold the operating member at the second operating position by the engaging member to further hold the working mechanism at the second state.

17. The slide rail kit of claim 16, wherein the slide rail comprises a first wall, a second wall and a longitudinal connected between the first wall and the second wall of the slide rail; wherein when the working mechanism is in the first state, the working mechanism is adjacent to the first wall of the slide rail; wherein when the working mechanism is in the second state, the working mechanism is away from the first wall of the slide rail.

18. The slide rail kit of claim 16, wherein the engaging member is fixedly or movably connected to the slide rail.

* * * * *